US006529130B2

(12) United States Patent
Pakhomov

(10) Patent No.: US 6,529,130 B2
(45) Date of Patent: Mar. 4, 2003

(54) SYSTEM FOR DETECTING INTRUDERS

(75) Inventor: Alex Pakhomov, Ardsley, NY (US)

(73) Assignee: General Phosphorix LLC, Ardsley, NY (US)

( * ) Notice: Subject to any disclaimer, the term of this patent is extended or adjusted under 35 U.S.C. 154(b) by 0 days.

(21) Appl. No.: 09/788,235

(22) Filed: Feb. 16, 2001

(65) Prior Publication Data

US 2002/0113698 A1 Aug. 22, 2002

(51) Int. Cl.[7] ..... G08B 13/00
(52) U.S. Cl. ..... 340/566; 340/541
(58) Field of Search ..... 340/541, 566, 340/567, 565, 552, 544

(56) References Cited

U.S. PATENT DOCUMENTS 4,107,660 A * 8/1978 Chleboun ..... 340/566
4,991,146 A * 2/1991 Ransdell et al. ..... 367/909
5,914,655 A * 6/1999 Clifton et al. ..... 340/506
5,969,608 A * 10/1999 Sojdehei et al. ..... 340/539

* cited by examiner

*Primary Examiner*—Daniel J. Wu
*Assistant Examiner*—Sihong Huang
(74) *Attorney, Agent, or Firm*—I. Zborovsky

(57) ABSTRACT

Detection of an intruder includes providing a sensor which senses an action generated by an intruder and produces a signal, determining portions of the signal from individual steps and making values of the signal with this portion closer to one another, determining a main amplitude threshold, obtaining an enveloping line of initial data of the signal, determining maximum values of amplitudes of the enveloping line and time points corresponding to the maximum amplitudes, determining an average value of time intervals between neighboring maximums of amplitudes and an average square value of the intervals of an average value, making more accurate the average value of time intervals between neighboring maximums of amplitudes of the enveloping line and average squared deviation of the time intervals from an average value, as well as other parameters, and making a decision about a presence of an intruder from the thusly determined parameters.

4 Claims, 7 Drawing Sheets

SYSTEM FOR DETECTING INTRUDERS

BACKGROUND OF THE INVENTION

The present invention relates to systems for detecting intruders.

System of these general types are known in the art. They are based on different approaches. It is believed that there is a need to further improve the existing systems in the sense of increasing their accuracy for the purpose of more reliable and earlier detection of an intruder.

SUMMARY OF THE INVENTION

Accordingly, it is an object of present invention to provide an improved system of detecting an intruder.

In keeping with these objects and with others which will become apparent hereinafter, one feature of present invention resides, briefly stated, in a system which has the steps of providing a sensor which senses a seismic action generated in a ground by an intruder and produces a signal; determining portions of signals from individual steps and making values of the signal with this portion closer to one another; determining a main amplitude threshold; obtaining an enveloping line of initial data of the signal; determining maximum values of amplitudes of the enveloping line and time points corresponding to the maximum amplitudes; determining an average value of time intervals between neighboring maximums of amplitudes and an average square value of the intervals of an average value; making more accurate the average value of time intervals between neighboring maximums of amplitudes of the enveloping line and average squared deviation of the time intervals from an average value, as well as other parameters; and making a decision about a presence of an intrude from the thusly determined parameters.

When the system is designed in accordance with the present invention, it provides a high accuracy of detecting an intruder.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
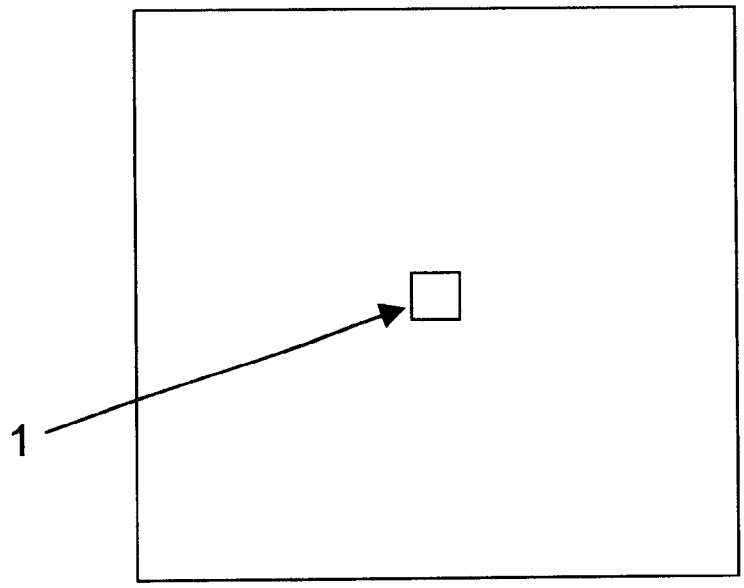
FIGS. 1–8 are views illustrating the method of operation of the system in accordance with the present invention.
Figure 2:
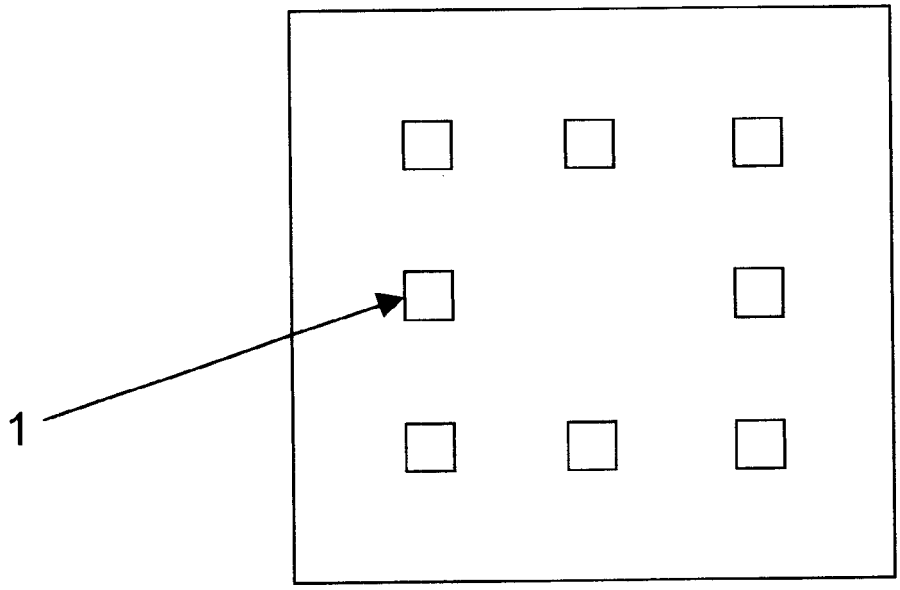
Figure 3:
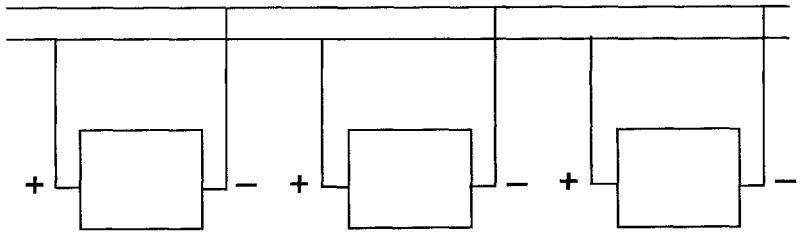

The system in accordance with the present invention can have one sensor which is identified in FIG. 1 with reference numeral 1 and is preferably located in a center of an area which is to be protected from an intruder. As shown in FIG. 2, the system can have a plurality of sensors. When the plurality of sensors 1 are arranged in the area, they are preferably connected with one another in parallel as shown in FIG. 3. In other words all plus poles of the sensors are connected with one wire and all minus poles are connected with the other wire of a connecting cable. The sensors can be seismic sensors, acoustic sensors, etc.

A signal which is generated by the sensors 1 is preliminarily amplified in a amplifier and the converted in an analog/digital convertor. Some sensors can incorporate the amplifier and the analog/digital convertor. The frequency of the conversion can be 64 Hz, or 128 Hz or 256 Hz. The lower is frequency of conversion, the simpler are microcontrollers for further processing. However, the distance of detection of intruder can be less than maximum. For maximum distance detection it is advisable frequency of 256 Hz.

The digitized signal is then subjected to a processing to determine whether it posses the properties of signals generated by intruders or not. The processing is performed by a microcontroller or computer. For processing, a portion of the signal for 4–6 sec is utilized. The beginning of each processing portion of the signal can be shifted relative to the beginning of the next proceeding portion by 1–4 sec. The lower shift allows detection of an intruder earlier, while the greater shift allows processing with simpler microcontrollers.

The drawing shows a shape of the signal which is generated by the sensor in response to actions of an intruder.

It is to be understood that depending on the type of the sensors, the signal has a corresponding nature. For example, the sensors which are utilized can be acoustic sensors which sends seismic waves and at the output produce corresponding voltage. They can be also seismic sensors, etc.

Figure 4:
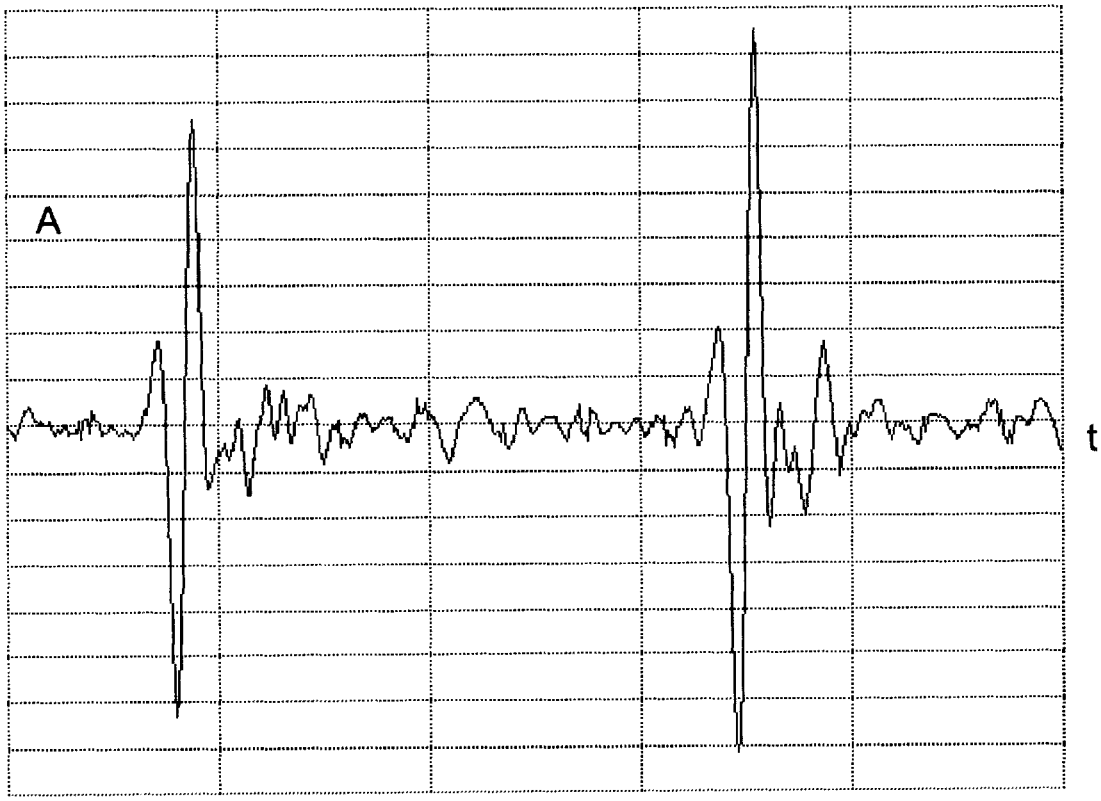
Figure 5A:
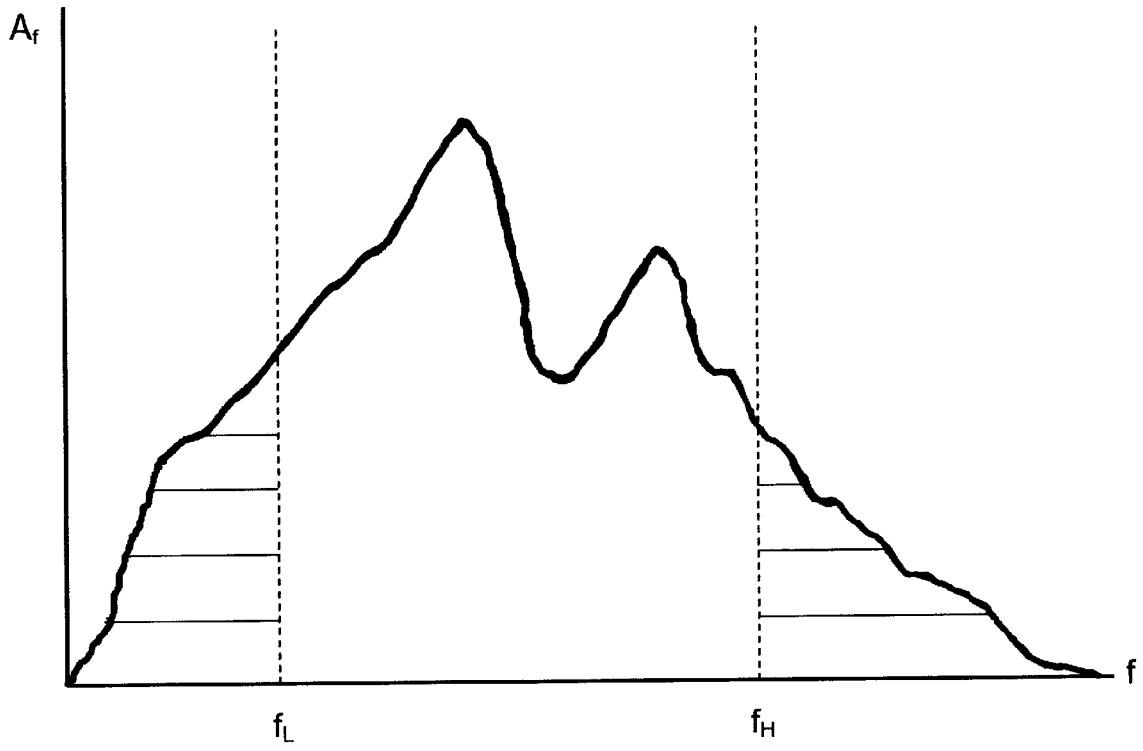
Figure 5B:
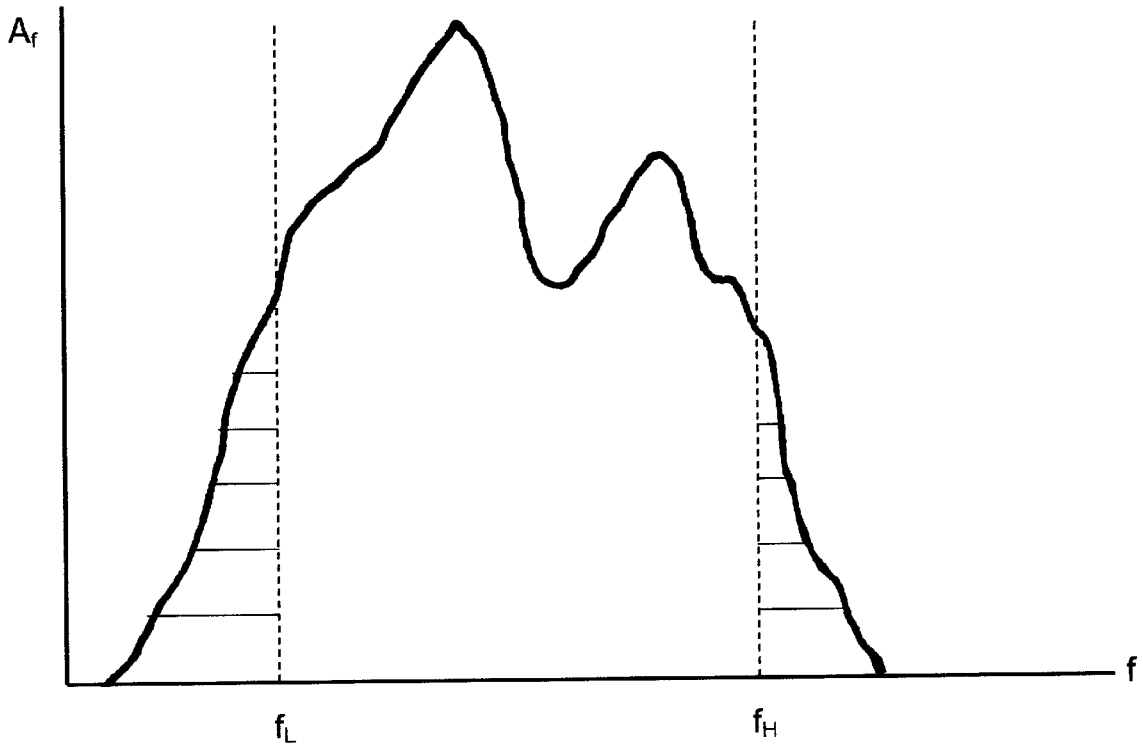
Figure 6A:
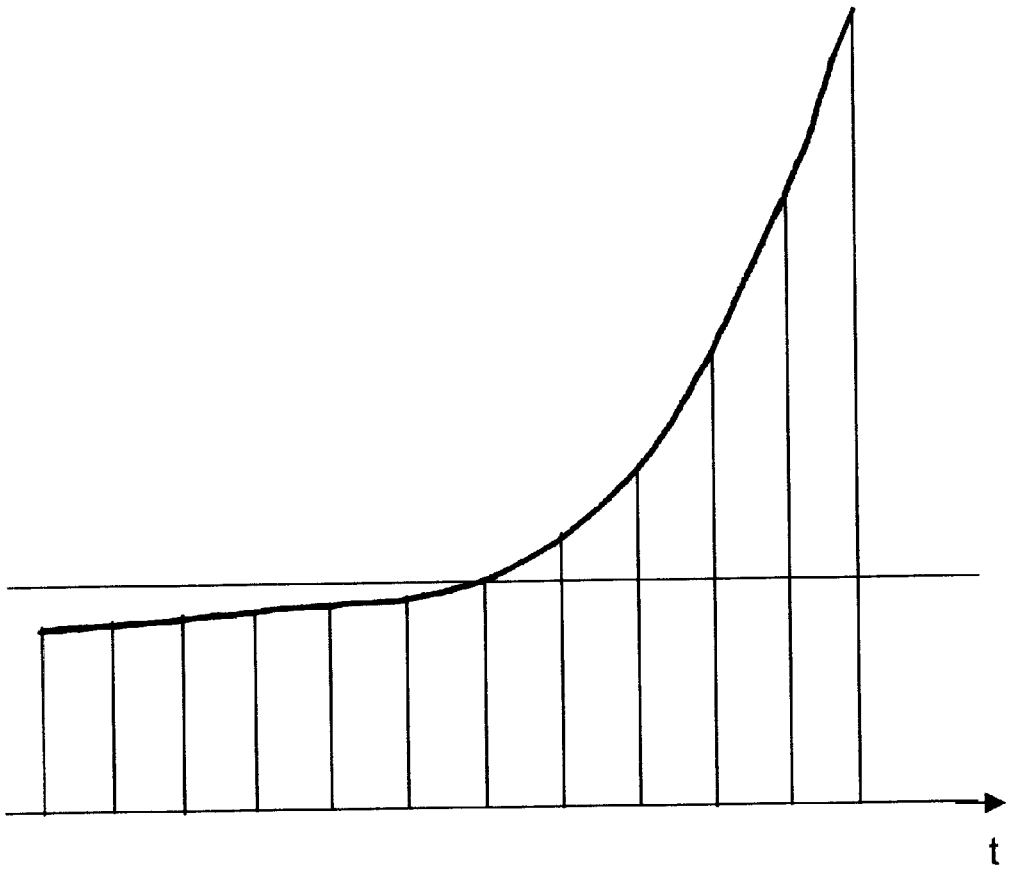
Figure 6B:
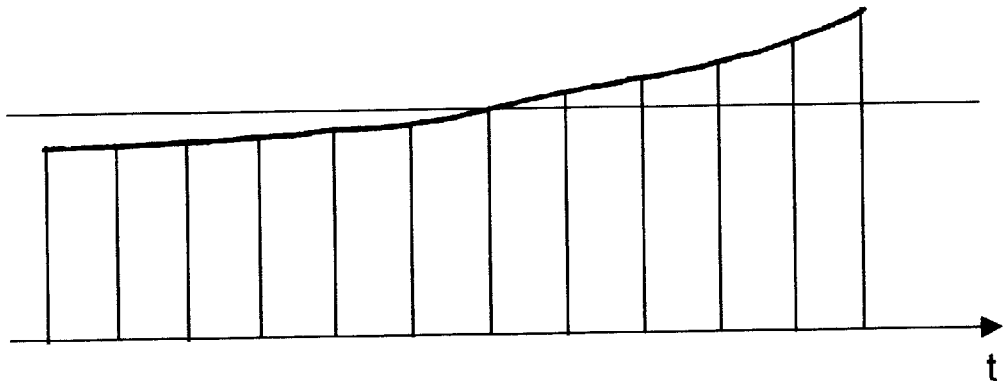

In the system the signal is further subjected to filtration, for the purpose of producing or eliminating the influence of seismo-acoustic and vibrational noise. For this purpose, before any actual detection of intruder the above mentioned noise can be determined in the area under the investigation, and thereafter when the signal resulting from the intrusion is generated, the noise is eliminated from the signal. The operation can be performed for example based on the fast fourier transform, or by digital recoursive filters. In FIG. 4 the signal is shown before filtering. FIGS. 5*a* and 5*b* show an amplitude or energy spectrum of the signal before and after filtration, respectively.

In accordance with the inventive system, the signal is further processed so as to change levels or amplitudes of signals from individual steps of an intruder to make them closer to one another. This is provided for excluding an influence of a sharp change of the level of signals which is observed during movement of the intruder in immediate vicinity from the sensor, for example 2–3 meters from the sensor. This processing is performed by calculating of average squared value of amplitude of the signal during a period of processing, and then the thusly determined value is multiplied by a predetermined number for example 2–3 so as to obtain a threshold. All values of amplitudes of the signal in the analyzed interval are compared with the thusly obtained threshold. A value which is lower than the threshold is left as is, while a value which is higher than threshold is reduced. A new value of signal amplitude is determined as the value of the threshold plus 0.01–0.001 of a difference between the threshold and the amplitudes above the threshold. Then a new average squared value of the amplitude of the signal over the processing time (4–6 seconds mentioned herein above) is calculated on the thusly processed amplitudes. In this step the amplitudes from individual steps of the intruder are made closer to one another.

In a next step, the main amplitude threshold is determined. For this purpose, beforehand a maximum permissible value of the main amplitude threshold is given. It is usually 0.002–0.015 of a maximum value of the signal which is caused by intruder in the immediate vicinity of the sensor. Then, a value equal to 0.85–1.2 of the average square value of signal amplitudes determined in the proceeding step is calculated. The maximum purpose of value of the main amplitude threshold is compared with the thusly calculated value. If the calculated value is lower than the maximum permissible value, the calculated value of the threshold remains unchanged. It is considered to be the main amplitude threshold. If the calculated value is higher than the maximum allowable value, the maximum allowable amplitude value is considered to be the main amplitude threshold.

Figure 7:
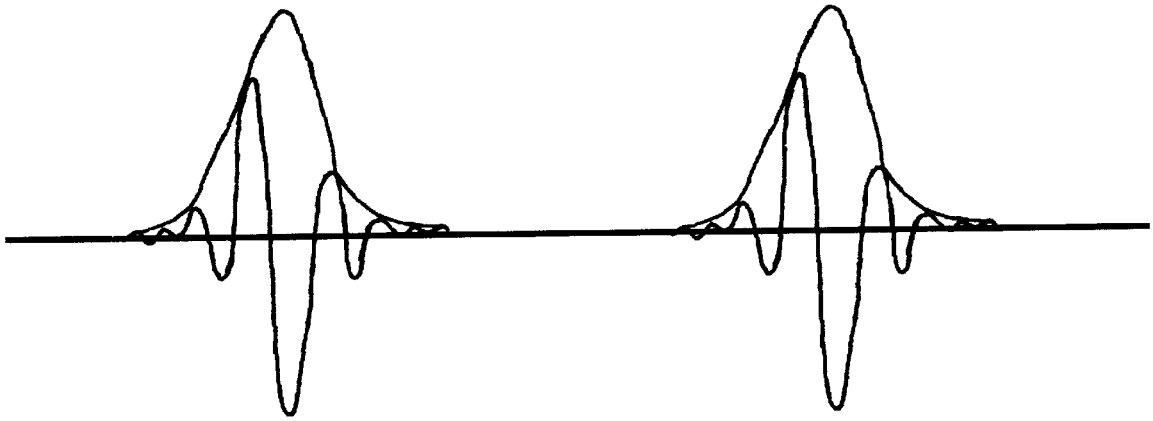

In the next step, an enveloping line of the signal is determined, as shown in FIG. 7. This can be performed for example by a method of digital detection of signal, for example in accordance with the following formula:

$$Zd(i)=Zd(i-1)+(Abs(Z(i))-Zd(i-1))/K_{USR}$$

wherein Z(i) is $i^{th}$ element of the signal from an initial data;

Zd(i) is $i^{th}$ element of the signal from the data which have passed to the detection:

$K_{USR}$ is an averaging coefficient which is usually equal 5–25, and Abs is a module of a corresponding value in the formula.

In accordance with another approach, it is possible to determine the enveloping line by an average squared averaging of the signal amplitudes in a so-called slipping "window". For this purpose on the time axis an averaging window is selected. The duration of the window is selected so that 2–4 periods of oscillations which are predominant in the spectrum of frequencies or oscillations caused during movement of the intruder are covered. For the majority of natural soils and movement conditions of intruder, the length of the window is 0.06–0.18 sec. With the consideration of the frequency of descriptive condition, it is determined how many counts are in the window of averaging. The number of such counts is a product of multiplication of the duration of window by frequency of description. This value is identified as J1. Then, the first element of data is provided with a value which is equal to average squared value of amplitude of first J1 counts of the initial data. The second element of the data of average values is provided with a value equal to the average squared value of amplitude from the second element to (J1+1) from initial data, etc. The last element of the averaged data is supplied with a value equal to average squared value of amplitudes of last J1 elements of the data. The averaged data are shorter than the initial data by the same number of counts.

It is also possible to determine the enveloping line by an averaging of the amplitudes of the detected signals.

Figure 8:
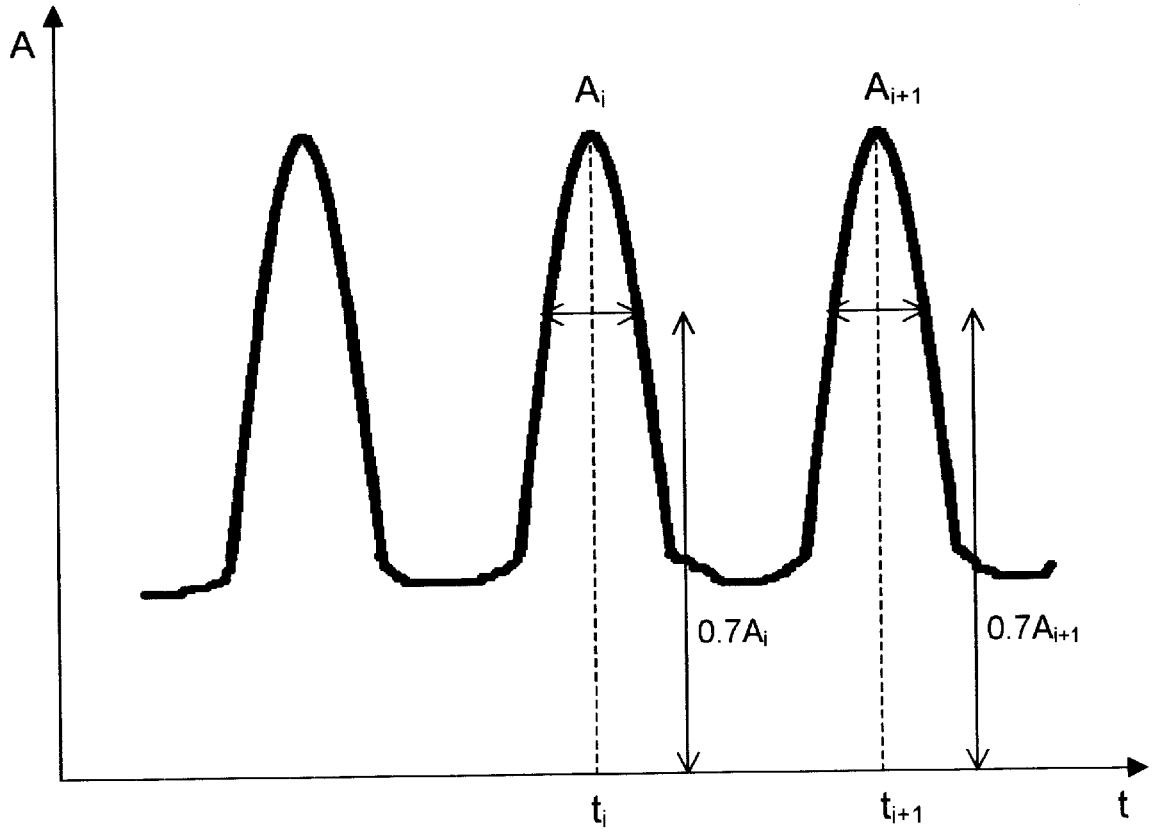

In the next step shown in FIG. 8, the enveloping curve is analyzed and the portions which are below the main amplitude threshold are removed. In the portions where the enveloping line is greater than the threshold, the moments of time which correspond to the moments of action of intruder on the ground are located. In other words, signals from individual steps of the intruder are located in these portions. In each of these portions a maximum value of amplitude of the enveloping line is determined, and a time corresponding to this maximum value is determined as well. For an analyzed interval of 4–6 seconds, several values of the maximum amplitudes and time points are determined.

In the next step, an average value of the intervals between the times corresponding to the amplitude maximums of the enveloping line are determined. Then an average squared deviation of each intervals from the average value is determined, and then a relative average squared deviation is determined, as a ratio of the second determined value and the first determined value in accordance with known formulas. The thusly obtained result corresponds to a relative stability of the determined actions of the intruder.

The next group of steps deal with a determination of accuracy of the average value of time intervals between neighboring maximums of amplitudes of the enveloping line, average squared deviation of the intervals from the average value, etc. For this purpose first of all the above determined average square deviation is compared with a predetermined stability threshold, which can be for example 10–15%. If the determined average square deviation is below 10–15%, the previously determined values are not changed. Thereafter an average value of maximum amplitude of the enveloping line from the action of intruder corresponding to the ends of the intervals are calculated, or in other words those which correspond to the moments of action of the intruder, for all portions where the enveloping line is above the main amplitude threshold. On the enveloping line at the level of 0.7 of the maximum amplitude of the enveloping line, an average value of the width of the enveloping line is determined, and then a number of time intervals between the actions of the intruder, the time points which correspond to ends of width intervals, an average value of maximum amplitudes of the enveloping line, and an average value of the width of the enveloping line are memorized.

If however the relative average squared deviation is above the stability threshold (10–15%), then from time intervals which were used before the maximum interval is removed. In the thusly reduced number of intervals the previous procedures of determination of the average value of the intervals and average squared deviation are performed, the thusly clarified relative average squared deviation is again compared with the stability threshold (10–15%), and if the stability is still not sufficient, then from the reduced set of intervals two smallest intervals are eliminated, and again the same procedures are performed, etc.

In the next step it is determined whether in the signals there are properties corresponding to signals generated by an intruder or not. A positive decision that there is an intruder is made when all following criteria are met:

It is first determined whether the average value of maximum amplitudes of signals of individual steps of intruder is higher than the average squared value of amplitudes of the signals, not less than 1.4–1.5. The first value must exceed the second value.

Then, it is determined whether the number of separated and selected for processing steps (actions) of intruder exceeds a result of division of the duration of the interval of processing (4–6 sec) by an average time interval between the selected steps (or in other words between neighboring maximums of amplitude of the enveloping line). The first value must exceed the second value.

Then it is determined whether the number of the separated for the processing steps (actions) of the intruder are higher than 4–5 units. The number must be higher.

Then it is determined whether the average squared deviation of time intervals between the steps of the intruder from its average value is lower than the predetermined threshold 0.01–0.5 sec. It must be lower.

It is then determined whether the ratio of the average squared deviation determined in the previous step to an average value of the time interval between the separate steps is lower than the threshold of 0.03–0.10. It must be lower.

It is further determined whether the average squared value of the signal amplitudes is higher than the determined threshold 0.002–0.06. It must be higher.

It is thereafter determined whether the average value of the width of the enveloping line is lower than 0.35–0.55 of the average time interval between the separated and selected steps of intruder. It must be lower.

Finally, it is determined whether an average time interval between the separated and selected steps of the intruder is within the predetermined interval 0.25 sec–1.5 sec, which corresponds to a range of possible speeds of movement of an intruder. It has to be located within this range.

If all this criteria are met, then, it is determined that there is an intruder.

In order to increase the reliability of the procedure, the above mentioned range can be subdivided into two or three intervals, for example 0.25 sec–0.5 sec, 0.5 sec–0.9 sec, 0.9 sec–1.5 sec. The sequence of the actions will be therefore performed, and corresponding parameters and thresholds of the proceeding steps will be changed, but within their corresponding ranges.

When it is determined that the intruder is present, a corresponding signal can be supplied to a user, for example audio signal, video signal, or both.

It will be understood that each of the elements described above, or two or more together, may also find a useful application in other types of constructions differing from the types described above.

While the invention has been illustrated and described as embodied in system for detecting intruders, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of detecting an intruder, comprising the steps of providing a sensor which senses an action generated by an intruder and produces a signal; determining portions of the signal from individual steps and making values of the signal within these portions closer to one another; determining a main amplitude threshold; obtaining an enveloping line of initial data of the signal; determining maximum values of amplitudes of the enveloping line and time points corresponding to the maximum amplitudes; determining an average value of time intervals between neighboring maximums of amplitudes and an average square value of the intervals from the average value; making more accurate the average value of time intervals between neighboring maximums of amplitudes of the enveloping line and average squared deviation of the time intervals from an average value; and making a decision about a presence of an intruder from the thusly determined values.

2. A method as defined in claim 1; and further comprising, before making portions of signals from separate steps closer to one another, filtering of the signal in order to filter out an influence of seismic-acoustic and vibration noise.

3. A method as defined in claim 1, wherein said obtaining an enveloping line includes obtaining by a method selected from the group consisting of a digital detecting of the signal, an average square averaging of the amplitudes of the signal, and both.

4. A method as defined in claim 1, wherein said making a decision based on corresponding parameters includes determination of whether a deviation of a corresponding parameter is above or below a certain threshold and within a certain range.

* * * * *